United States Patent [19]

Takenaka et al.

[11] 4,331,903

[45] May 25, 1982

[54] COLOR PICTURE TUBE AND METHOD FOR MAGNETICALLY ADJUSTING THE COLOR PICTURE TUBE

[75] Inventors: Shigeo Takenaka; Hisafumi Okada, both of Fukaya, Japan

[73] Assignee: Tokyo Shibaura Denki Kabushiki Kaisha, Kawasaki, Japan

[21] Appl. No.: 95,305

[22] Filed: Nov. 19, 1979

[30] Foreign Application Priority Data

Nov. 21, 1978 [JP] Japan ..... 53-142824

[51] Int. Cl.[3] ..... H01J 29/06

[52] U.S. Cl. ..... 313/413; 313/431

[58] Field of Search ..... 313/440, 431, 413, 402; 316/1; 315/370, 401

[56] References Cited

U.S. PATENT DOCUMENTS 3,867,668 2/1975 Shrader ..... 313/402 X

OTHER PUBLICATIONS

Japanese Patent Publication (Kokoku), No. 50-35769, Takenaka, Nov. 19, 1975.

Japanese Patent Disclosure (Kokai), No. 51-122322, Philips, Oct. 26, 1976.

*Primary Examiner*—Palmer C. Demeo

*Assistant Examiner*—Darwin R. Hostetter

*Attorney, Agent, or Firm*—Cushman, Darby & Cushman

[57] ABSTRACT

A color picture tube comprises the vacuumed tube envelope formed by a face plate having a plurailty of phosphor strips regularly formed on the inner surface, a funnel section having an enlarged end opening on which the face plate is mounted a skirt section on which deflection yoke is mounted and neck integrally formed with the funnel section and having located therein an electron gun assembly for emitting electron beams. A shadow mask having a plurality of slits therein is disposed to face to the inner surface of the face plate. The shadow mask is provided on an integral mask frame by which the shadow mask is secured to the inner surface of the tube envelope. The mask frame has an inner shield secured thereto along the inner circumference of the envelope. The inner shield is coupled to a permanent magnet member faced to the inner surface of the envelope. The member is to be preliminarily strongly magnetized and each section thereof is demagnetized and adjusted to a determined value to present a determined intensity of magnetism. The plate serves to change the path of the electron beams, thereby appropriately directing the electron beams toward the determined phosphor strips.

11 Claims, 2 Drawing Figures

COLOR PICTURE TUBE AND METHOD FOR MAGNETICALLY ADJUSTING THE COLOR PICTURE TUBE

BACKGROUND OF THE INVENTION

This invention relates to a colour picture tube and a method for adjusting a colour picture tube. In order to provide a good colour purity in a colour picture tube, three electron beams emitted from the electron gun assembly have to correctly impinge on the centers of the respective red, green and blue phosphor strips or dots formed on the face plate of the tube. Adjustment for colour purity is unnecessary, if components of a colour picture tube are manufactured in a sufficient preciseness and assembled together in a sufficient precise fashion. But certain practical limitations are imposed on preciseness of mechanical components and tolerance errors are unavoidably involved when they are assembled, so that any colour picture tube calls for adjustment for colour purity. An error caused particularly when a shadow mask is mounted inside of the skirt section of the face plate often necessitates such a later adjustment for colour purity. Specifically, in a colour picture tube assembling process, some internal or external stress may be often applied to a shadow mask, so that dot apertures or slits in the shadow mask will be shifted out of alignment with the corresponding dots or phosphor strips on the face plate, and/or so that the shadow mask itself will be deformed. Such shift of the apertures or slits of the shadow mask and deformation of the shadow mask are as small as the order of 10 to 30 microns, but when the related components are affected by terrestrial magnetism, such errors are enlarged to a degree enough to render colour purity of the tube poor.

Conventionally, fine adjustment of a mounting position of the deflection yoke and adjustment of the purity magnet are made to correct a poor colour purity so that good colour purity can be obtained by the assembled colour picture tube.

As well known in the art, the deflection yoke requires a higher order of technique in its positional adjustment. Moreover, it is heavy, 500 to 1700 g, and after adjustment it is gradually displaced with its own weight. Further, not only the deflection yoke, but colour purity magnet and convergence yoke have to be adjusted in the operation of colour purity adjustment, so that the adjustment operation disadvantageously requires long time. Another problem has frequently been experienced in the conventional method of colour purity adjustment that while the intended areas of the shadow mask can be fully adjusted, the other areas remain not fully adjusted, i.e., that the entire area of the shadow mask can not be correctly adjusted.

SUMMARY OF THE INVENTION

One object of the invention is to provide a colour picture tube which does not necessitate colour purity adjustment by relocation of the deflection yoke after assembly of the colour picture tube.

Another object of the invention is to provide a colour picture tube having colour purity suitably adjusted in respect to the entire area of phosphor strips or dots formed on the face plate of the tube.

Still other object of the invention is to provide a simplified method of colour purity adjustment for colour picture tube.

According to the invention, there is provided a colour picture tube which comprises:

a vacuum envelope having a face plate, a funnel section, yoke section and a neck;

a phosphor layer of phosphor patterns regularly arrayed on the inner surface of the face plate;

a shadow mask faced to the inner surface of the face plate and having a plurality of apertures corresponding to said phosphor patterns;

an electron gun assembly disposed in the neck for emitting electron beams to be landed through said aperture of said shadow mask at the phosphor patterns of the face plate;

a deflection yoke disposed on the yoke section for deflecting electron beams emitted from said electron gun assembly; and a magnetized permanent magnetic means located along the inner surface of said tube envelope along the electron beam path deflected by said deflection yoke.

According to the invention, there is further provided a method for adjusting a colour picture tube which comprises the step of magnetizing the permanent magnet means of said colour picture tube while electron beams are generated from the electron gun assembly and caused to be landed on the phosphor patterns.

According to the invention, there is still further provided a method for adjusting a colour picture tube which comprises the step of preliminarily strongly magnetizing the permanent magnet means in said colour picture tube, and demagnetizing the permanent magnet means while electron beams generated from an electron gun assembly are landed on the phosphor patterns.

DETAILED DESCRIPTION OF THE INVENTION

Figure 1:
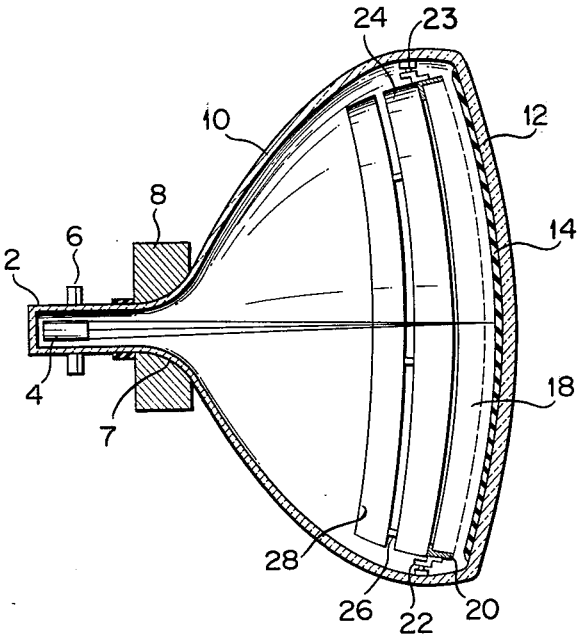
FIG. 1 is a cross sectional view diagrammatically showing one embodiment of the colour picture tube according to the invention.

Referring to FIG. 1, there is schematically shown a colour picture tube embodied by the invention. The colour picture tube, as well known in the art, has an electron gun assembly 4 disposed in the neck 2 for generating three electron beams and an adjustment member 6 disposed on the neck. The adjustment member is constituted by colour purity magnet and convergence magnet. A deflection yoke 8 is secured on a yoke section 7. The yoke section 7 extends with the diameter being gradually enlarged to define a funnel section 10 which has an open end on which a face plate 12 is secured. The tube envelope interior surrounded by neck 2, funnel section 10 and face plate 12 is vacuumed. A phosphor layer is formed on the inner surface of the face plate 12 and has a plurality of red, green and blue phosphor strips or dots 14 regularly arrayed thereon and adapted to fluoresce in red, green and blue, respectively, in response to landing of the corresponding electron beams. A shadow mask 18 having a plurality of dot apertures or slits formed therein is faced to the inner surface of the face plate 12. The mask 18 is integrally supported by a mask frame 20. The mask frame 20 is carried in the skirt section of the face plate 12 by means of springs 22 connected to panel pins 23 which in turn are embedded in the face plate flange. An inner shield 24 is secured to the mask frame 20 and have a closed-loop configuration along the inner circumferential surface of tube. A magnetic member 28 for fine adjusting the trajectory of the electron beams is coupled to the inner shield 24 through connecting bars 26 and also have a rectangular closed-loop and bank-like configuration. The permanent magnet member 28 may not be secured to the inner shield 24, but be located along the inner surface of the tube envelope by any suitable means. The permanent magnet member 28 is provided thereon with a suitable number of sections magnetized in different intensities and directions from each other for the purposes of colour purity adjustment. In manufacture, the permanent magnet member 28 is made from the vicalloy, the Spinodal (trade name) or any other material which is adapted to be preliminarily strongly magnetized throughout all the sections which are then each demagnetized in different degree from outside of the tube in a manner hereinafter stated, so that the respective sections have favourable intensities of magnetization. It is favourable that the permanent magnet member 28 be not located near the deflection yoke 8 because the permanent magnet member, if located adjacent the deflection yoke, may disturb the field generated by the deflection yoke or the magnetized sections of the permanent magnet member may be influenced by the field of the deflection yoke, and that the permanent magnet member be spaced from the inner shield 24 at a predetermined distance to prevent magnetization of the inner shield upon magnetization of the permanent magnet member. If the inner shield 24 is magnetized, an effective magnetism for adjustment applied becomes too great. In one modification, the permanent magnet member 28 is omitted and the inner shield 24 is made of a permanent magnet member which is magnetized and subjected to a similar demagnetization treatment as above-mentioned. Alternatively, the loop-band configuration of the permanent magnet member may be replaced by a plurality of permanent magnet plates mounted on the inner shield 24 in an appropriate array of distribution of intensity and directions of magnetism.

In operation, electron beams emitted from the electron gun assembly 4 are deflected by the deflection yoke, and any electron beam which have been thereby directed to mis-land on the phosphor strip has the trajectory rectified by action of the magnetic field generated by the permanent magnet member 28, so that they are directed to land right on the center of the respective phosphor strips 14. Consequently, the phosphor strips are excited to emit the determined colour light rays improving colour purity of the colour picture tube.

A colour purity adjustment method for the above described colour picture tube will be described.

When electron gun assemble 4, shadow mask 18 and inner shield 24 are incorporated in a normally known manner in the interior of the tube envelope defined by face plate 12 on which the phosphor strips 14 are formed, the funnel section 10, yoke section 7 and neck 2, the permanent magnet member 28 together with the inner shield may be accommodated in the tube envelope interior. Then, the deflection yoke 8 is mounted on the neck 2, and the adjustment member 6 is also mounted thereon.

During the assembly of the picture tube, a dimentional error or positional displacement occurs, such as the deformation of the shadow mask 18, or a partial or whole shift in a positional relation between phosphor strips 14 on the face plate 12 and slit in the shadow mask 18. Amounts of such shifts will differ in one product of the picture tube from another even insofar as one single type or products of the picture tube is concerned.

Figure 2:
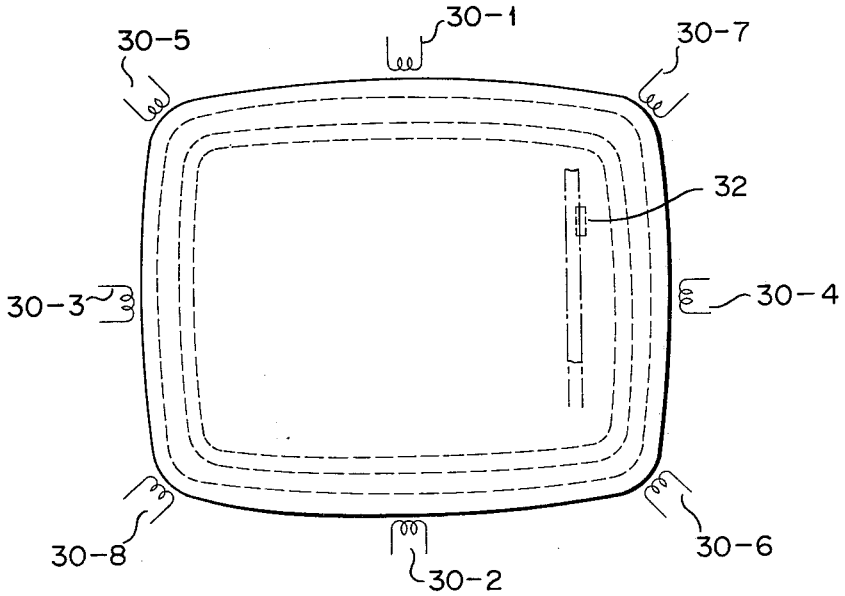
FIG. 2 is a schematic front view of the colour picture tube for facilitating explanation of an adjustment method for the colour picture tube of FIG. 1.

The tube envelope having such shifts is mounted in a magnetization and demagnetization apparatus of FIG. 2 which comprises a plurality of magnetization coils 30-1 to 30-8 adapted to be positioned around the circumference of a tube envelope. In one embodiment, as shown, eight coils 30-1 to 30-8 in all are provided around the face plate 12, one adjacent each of the four corners and the four sides of the latter.

The permanent magnet member 28 within the tube envelope mounted in the magnetization and demagnetization apparatus is preliminarily strongly magnetized by action of the magnetic field generated by the coils 30-1 to 30-8 to a saturated point. Electron beams are generated from electron gun assembly and caused to be landed on the phosphor strips 14, in order to ascertain whether the beams are landed right on the center of phosphor strips 14. When the beams are landed out of the center as at reference numeral 32 shown in FIG. 2, suitable ones of the coils are energized and adjusted to demagnetize an appropriate section of the magnetized permanent magnet member 28 to have a predetermined amount of magnetization, thereby to cause the electron beams to be correctly landed on the phosphor strips 14. The magnet member 28 may be magnetized by means of the coils 30-1 to 30-8 not in the same direction throughout all the corresponding sections to the coils, but in the different directions from one to other sections.

As mentioned above, the method for preliminarily and strongly magnetizing the permanent magnet member 28 and then demagnetizing a predetermined section of the member 28 is desirable. However, the magnetizing of the permanent magnet member 28 may be gradually increased without demagnetization step to the extent that a predetermined amount of magnetization is imparted to a predetermined section of the magnet member.

The adjustment method above explained permits electron beams to correctly land at the center of each of the phosphor strips 14 on the face plate 12. The adjustment method of the invention dispenses with operation of relocating the deflection yoke 8 after assembly of colour picture tubes, thus simplifying the operation of colour purity adjustment. Because of the deflection yoke 8 need not be relocated after assembly, the yoke can be permanently bonded to the neck or funnel section by adhesive agent or adhesive tape. The method of the invention will simplify the operation of mounting of deflection yoke on the tube envelope.

It is thus apparent from the foregoing explanation that the invention provides a colour picture tube capable of easy colour purity adjustment and method for manufacturing such a colour picture tube.

What is claimed is:

1. A colour picture tube comprising:

a vacuum tube envelope having a face plate, a funnel section, a yoke section and a neck;

a phosphor layer of phosphor patterns regularly arrayed on the inner surface of the face plate;

a shadow mask faced to said inner surface of the face plate and having a plurality of apertures corresponding to said phosphor patterns;

an electron gun assembly disposed in the neck for emitting electron beams to pass through said aperture of said shadow mask and impinge on the phosphor patterns on the face plate;

a deflection yoke disposed on the yoke section for deflecting electron beams emitted from said electron gun assembly; and a magnetized permanent magnetic means for fine adjusting the trajectory of the electron beams located along the inner surface of said tube envelope along the electron beam path deflected by said deflection yoke.

2. The colour picture tube according to claim 1 where said permanent magnet member is made of the vicalloy.

3. The colour picture tube according to claim 1 where said permanent magnet member is constituted by a loop band faced to the inner surface of said tube envelope and having a plurality of sections provided with predetermined intensities of magnetization.

4. The colour picture tube according to claim 1 where said permanent magnet member is constituted by a plurality of permanent magnet plates arrayed along the inner circumferential surface of said tube envelope, each of said permanent magnet plates being magnetized in a predetermined intensity.

5. The colour picture tube according to claim 1 further comprising supporting means for supporting said shadow mask, said permanent magnet member being supported by said supporting means.

6. The colour picture tube according to claim 1 further comprising supporting means for supporting said shadow mask, said permanent magnet member being constituted by inner shield means supported also by said supporting means.

7. The colour picture tube according to claim 1 further comprising supporting means for supporting said shadow mask and inner-shield means supported by said supporting means, said permanent magnet member being supported by said inner-shield means.

8. The colour picture tube according to claim 1, wherein said apertures are slits.

9. The colour picture tube according to claim 1, wherein said apertures are dot apertures.

10. A method for adjusting an assembled colour picture tube which comprises;

a vacuum tube envelope having a face plate, a yoke section, a funnel section and a face plate;

a phosphor layer of phosphor patterns regularly arrayed on the inner surface of the face plate;

a shadow mask faced to said inner surface of the face plate and having a plurality of apertures corresponding to said phosphor patterns;

an electron gun assembly disposed in the neck for emitting electron beams to be landed through said aperture of said shadow mask on the phosphor patterns on the face plate;

a deflection yoke disposed on the yoke section for deflecting electron beams emitted from said electron gun assembly; and a permanent magnet means located along the inner surface of said tube envelope along an electron beam path deflected by said deflection yoke;

said adjustment method comprising the steps of magnetizing the permanent magnet means of said colour picture tube while electron beams are generated from the electron gun assembly and caused to be impinged on the phosphor patterns.

11. A method for adjusting an assembled colour picture tube which comprises:

a vacuum tube envelope having a face plate, a yoke section, a funnel section and a neck;

a phosphor layer of phosphor patterns regularly arrayed on the inner surface of the face plate;

a shadow mask faced to said inner surface of the face plate and having a plurality of apertures corresponding to said phosphor patterns;

an electron gun assembly disposed in the neck for emitting electron beams to be landed through said aperture of said shadow mask on the phosphor patterns on the face plate;

a deflection yoke disposed on the yoke section for deflecting electron beams emitted from said electron gun assembly;

a permanent magnetic means located along the inner surface of said tube envelope along an electron beam path deflected by said deflection yoke; said adjustment method comprising the steps of:

strongly magnetizing said permanent magnet means outside from said tube envelope; and demagnetizing a predetermined section of said permanent magnet means while electron beams generated from an electron gun assembly are impinged on the phosphor patterns.

* * * * *